US011220647B2

(12) United States Patent
Mulqueen

(10) Patent No.: US 11,220,647 B2
(45) Date of Patent: Jan. 11, 2022

(54) DIESEL FUEL COMPOSITIONS AND METHODS OF USE THEREOF

(71) Applicant: Innospec Limited, Ellesmere Port (GB)

(72) Inventor: Simon Mulqueen, Ellesmere Port (GB)

(73) Assignee: Innospec Limited, Ellesmere Port (GB)

( * ) Notice: Subject to any disclaimer, the term of this patent is extended or adjusted under 35 U.S.C. 154(b) by 0 days.

(21) Appl. No.: 16/876,879

(22) Filed: May 18, 2020

(65) Prior Publication Data

US 2020/0277537 A1 Sep. 3, 2020

Related U.S. Application Data

(63) Continuation of application No. 14/905,188, filed as application No. PCT/GB2014/052309 on Jul. 28, 2014, now abandoned.

(30) Foreign Application Priority Data

Jul. 26, 2013 (GB) ..... 1313400
Feb. 3, 2014 (GB) ..... 1401825

(51) Int. Cl.

| | |
|---|---|
| ***C10L 10/04*** | (2006.01) |
| ***C10L 10/06*** | (2006.01) |
| ***C10L 1/222*** | (2006.01) |
| ***C10L 10/18*** | (2006.01) |
| ***C10L 1/238*** | (2006.01) |
| ***C10L 1/22*** | (2006.01) |

(Continued)

(52) U.S. Cl.

CPC ..... *C10L 10/04* (2013.01); *C10L 1/22* (2013.01); *C10L 1/2222* (2013.01); *C10L 1/238* (2013.01); *C10L 10/06* (2013.01); *C10L 10/18* (2013.01); *F02M 25/00* (2013.01); *C10L 1/221* (2013.01); *C10L 1/224* (2013.01); *C10L 1/2383* (2013.01); *C10L 1/2387* (2013.01); *C10L 2200/0259* (2013.01); *C10L 2270/026* (2013.01)

(58) Field of Classification Search

CPC ..... C10L 2270/026; C10L 2230/08; C10L 10/04; C10L 1/2222
USPC ..... 44/422
See application file for complete search history.

(56) References Cited

U.S. PATENT DOCUMENTS 5,588,937 A 12/1996 Kono et al.
5,925,151 A 7/1999 DeCanio et al.
(Continued)

FOREIGN PATENT DOCUMENTS

RU 2226206 C2 6/2002
WO 2006135881 A3 12/2006
(Continued)

OTHER PUBLICATIONS

International Search Report, PCT/GB2014/052309 dated Oct. 10, 2014.
(Continued)

*Primary Examiner* — Ellen M Mcavoy
(74) *Attorney, Agent, or Firm* — Burns & Levinson LLP; Janine M. Susan

(57) ABSTRACT

A method of combating internal diesel injector deposits caused by carboxylate residues and/or lacquers in the injectors of a diesel engine, the method comprising combusting in the engine a diesel fuel composition comprising (a) the reaction product of a carboxylic acid-derived acylating agent and an amine and (b) a quaternary ammonium salt additive.

16 Claims, 1 Drawing Sheet

(51) Int. Cl.

| | |
|---|---|
| ***F02M 25/00*** | (2006.01) |
| *C10L 1/2383* | (2006.01) |
| *C10L 1/2387* | (2006.01) |
| *C10L 1/224* | (2006.01) |

(56) References Cited

U.S. PATENT DOCUMENTS

| | | | | |
|---|---|---|---|---|
| 6,299,655 | B1 | 10/2001 | Steckel et al. | |
| 6,733,550 | B1 | 5/2004 | Grundy et al. | |
| 7,291,758 | B2 | 11/2007 | Bohnenpoll et al. | |
| 7,947,093 | B2 | 5/2011 | Barton et al. | |
| 7,951,211 | B2 | 5/2011 | Barton et al. | |
| 8,147,569 | B2 | 4/2012 | Barton et al. | |
| 9,365,787 | B2 | 6/2016 | Reid et al. | |
| 9,487,719 | B2 | 11/2016 | Arters et al. | |
| 9,574,149 | B2 | 2/2017 | Fang et al. | |
| 2008/0052985 | A1 | 3/2008 | Stevenson et al. | |
| 2008/0113890 | A1 | 5/2008 | Moreton et al. | |
| 2008/0236030 | A1 | 10/2008 | Roberts et al. | |
| 2008/0307698 | A1 | 12/2008 | Barton et al. | |
| 2010/0257779 | A1* | 10/2010 | Barton | C10M 133/56 44/422 |
| 2010/0293844 | A1* | 11/2010 | MacMillan | C10L 1/238 44/419 |
| 2011/0143981 | A1* | 6/2011 | Barton | C10L 1/2383 508/370 |
| 2011/0258917 | A1 | 10/2011 | Castro et al. | |
| 2011/0302828 | A1 | 12/2011 | Fang et al. | |
| 2011/0315107 | A1 | 12/2011 | Grabarse et al. | |
| 2012/0010112 | A1 | 1/2012 | Grabarse et al. | |
| 2012/0255512 | A1 | 10/2012 | Galante-Fox et al. | |
| 2013/0031828 | A1* | 2/2013 | Reid | C10L 10/04 44/386 |
| 2013/0074794 | A1 | 3/2013 | Fang | |
| 2013/0131827 | A1 | 5/2013 | Cassivi et al. | |
| 2013/0133243 | A1 | 5/2013 | Roeger-Goepfert et al. | |
| 2013/0192124 | A1* | 8/2013 | Arters | C10L 10/04 44/307 |
| 2013/0225463 | A1 | 8/2013 | Hansch et al. | |
| 2013/0296210 | A1 | 11/2013 | Hansch et al. | |
| 2014/0174390 | A1 | 6/2014 | Reid et al. | |
| 2015/0232774 | A1 | 8/2015 | Fang et al. | |
| 2015/0252278 | A1 | 9/2015 | Bush et al. | |
| 2015/0266808 | A1 | 9/2015 | Hansch et al. | |
| 2016/0130514 | A1* | 5/2016 | Hansch | C10L 1/222 508/547 |
| 2016/0152910 | A1 | 6/2016 | Reid et al. | |

FOREIGN PATENT DOCUMENTS

| | | | |
|---|---|---|---|
| WO | 2009040583 | A1 | 4/2009 |
| WO | 2009040586 | A1 | 4/2009 |
| WO | 2009055518 | A1 | 4/2009 |
| WO | 2010097624 | A1 | 9/2010 |
| WO | 2010132259 | A1 | 11/2010 |
| WO | 2011110860 | A1 | 9/2011 |
| WO | 2011141731 | A1 | 11/2011 |
| WO | 2012177529 | A1 | 12/2012 |
| WO | 2014202425 | A2 | 12/2014 |

OTHER PUBLICATIONS

International Preliminary Report onPatentability, PCT/GB2014/052309 dated Jan. 26, 2016.

Reid, J. and Barker, J., "understanding Polyisobutylene Succinimides (PIBSI) and Internal Diesel Injector Deposits," SAE Technical Paper 2013-01-2682, 2013.

Arters, David "The Lowdown on IDID" Lubrizol Corporation, Fuel Magazine, 2012.

Arondel, M., Rodeschini, H., Lopes, M., and Dequenne, B., "Fuel Additives for Reduction of Internal Diesel Injections Deposits (IDID, "lacquering"): A Critical and Priority Route," SAE Technical Paper 2012-01-1687, 2012.

Amendment and Response to Final Office Action under the After Final Consideration Pilot 2.0 in U.S. Appl. No. 13/583,024 filed on Dec. 5, 2017 at the U.S. Patent and Trademark Office (USPTO).

Amendment and Response to Final Office Action dated Apr. 28, 2014 in U.S. Appl. No. 13/583,024, filed Jun. 30, 2014 at the United States Patent & Trademark Office.

Response to Rule 70(2) and 70a(2) EPC Communications dated Jan. 18, 2016 filed on Jul. 13, 2016 at the European Patent Office ("EPO").

Declaration by Dr. Scott D. Schwab dated Jan. 7, 2019 relating to Opposition Against Patent No. EP 3 024 914 Appln. No. 14744945.8) Proprietor: Innospec Limited Opponent: Afton Chemical Corporation.

Fuel additives and the environment, Additive Technical Committee, Jan. 2004.

JA Kemp, Statement of Facts and Arguments in Support of Opposition, Patent No. EP 3024914, Application H4744945.8, Patentee Innospec Limited, Opponent Afton Chemical Corporation, Jan. 10, 2019.

Communication of a Notice Of Opposition for European Application No. 14744945.8 issued on Jan. 15, 2019.

Ullmann et al., Effects of Fuel Impurities and Additive Interactions on the Formation of Internal Diesel Injector beposi1su Robert Bosch GmbH, Corporate Sector Research and Advance, 7th International Colloquium Fuels, Jan. 2009.

Written Opinion from related Singapore application No. 11201600607X dated Dec. 27, 2016.

Great Britain Search Report dated Jan. 27, 2014 for GB1313400.2.

* cited by examiner

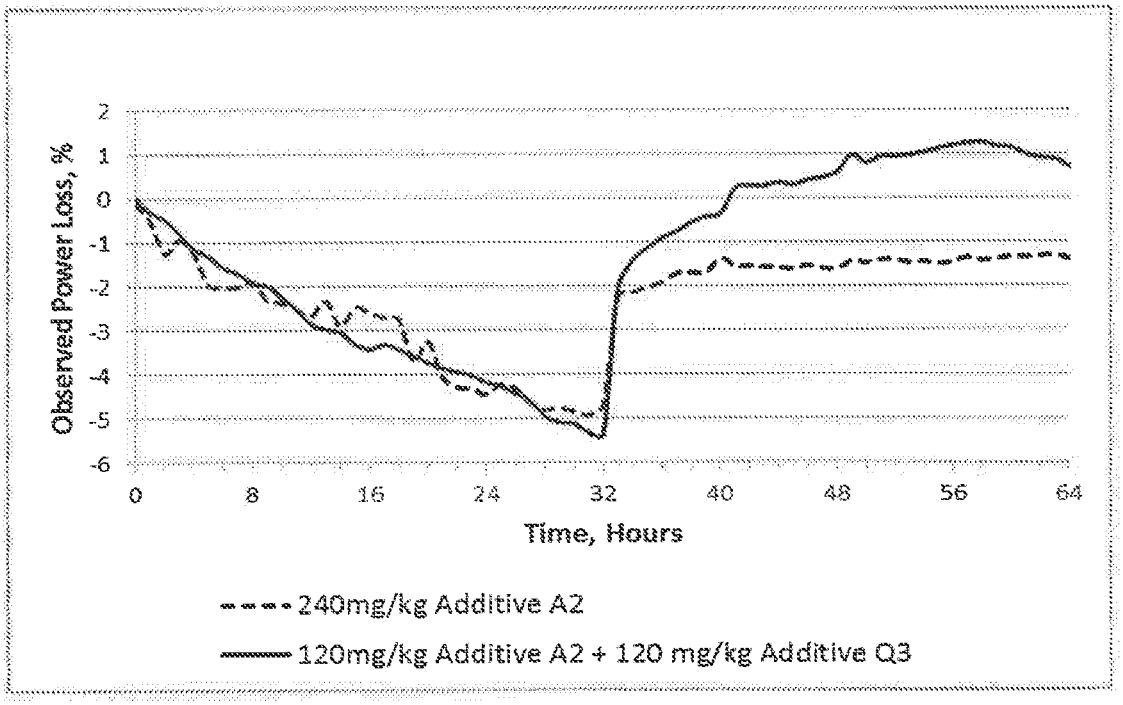
Observed Power Loss, %
2
1
0
-1
-2
-3
-4
-5
-6
0
8
16
24
32
40
48
56
64
Time, Hours
240mg/kg Additive A2
120mg/kg Additive A2 + 120 mg/kg Additive Q3

DIESEL FUEL COMPOSITIONS AND METHODS OF USE THEREOF

CROSS-REFERENCE TO RELATED APPLICATIONS

This application is a continuation of co-pending U.S. patent application Ser. No. 14/905,188, filed Jan. 14, 2016, entitled DIESEL FUEL COMPOSITIONS AND METHODS OF USE THEREOF, which is a U.S. national stage application under 35 U.S.C. 371 of International Application No. PCT/GB2014/052309, filed on Jul. 28, 2014, which in turn claims priority to Great Britain Patent Application No. 1313400.2, filed on Jul. 26, 2013, Great Britain Patent Application No. 1401825.3, filed on Feb. 3, 2014, and Great Britain Patent Application No. 1313400.2, filed Jul. 26, 2013, the contents of which are incorporated herein by reference in their entirety for all purposes.

The present invention relates to methods and uses for improving the performance of diesel engines using fuel additives. In particular the invention relates to additives for diesel fuel compositions for use in diesel engines with high pressure fuel systems.

Due to consumer demand and legislation, diesel engines have in recent years become much more energy efficient, show improved performance and have reduced emissions.

These improvements in performance and emissions have been brought about by improvements in the combustion process. To achieve the fuel atomisation necessary for this improved combustion, fuel injection equipment has been developed which uses higher injection pressures and reduced fuel injector nozzle hole diameters. The fuel pressure at the injection nozzle is now commonly in excess of 1500 bar ($1.5\times10^8$ Pa). To achieve these pressures the work that must be done on the fuel also increases the temperature of the fuel. These high pressures and temperatures can cause degradation of the fuel. Furthermore, the timing, quantity and control of fuel injection has become increasingly precise. This precise fuel metering must be maintained to achieve optimal performance.

Diesel engines having high pressure fuel systems can include but are not limited to heavy duty diesel engines and smaller passenger car type diesel engines. Heavy duty diesel engines can include very powerful engines such as the MTU series 4000 diesel having 20 cylinder variants designed primarily for ships and power generation with power output up to 4300 kW or engines such as the Renault dXi 7 having 6 cylinders and a power output around 240 kW. A typical passenger car diesel engine is the Peugeot DW10 having 4 cylinders and power output of 100 kW or less depending on the variant.

In all of the diesel engines relating to this invention, a common feature is a high pressure fuel system. Typically pressures in excess of 1350 bar ($1.35\times10^8$ Pa) are used but often pressures of up to 2000 bar ($2\times10^8$ Pa) or more may exist.

Two non-limiting examples of such high pressure fuel systems are: the common rail injection system, in which the fuel is compressed utilizing a high-pressure pump that supplies it to the fuel injection valves through a common rail; and the unit injection system which integrates the high-pressure pump and fuel injection valve in one assembly, achieving the highest possible injection pressures exceeding 2000 bar ($2\times10^8$ Pa). In both systems, in pressurizing the fuel, the fuel gets hot, often to temperatures around 100° C., or above.

In common rail systems, the fuel is stored at high pressure in the central accumulator rail or separate accumulators prior to being delivered to the injectors. Often, some of the heated fuel is returned to the low pressure side of the fuel system or returned to the fuel tank. In unit injection systems the fuel is compressed within the injector in order to generate the high injection pressures. This in turn increases the temperature of the fuel.

In both systems, fuel is present in the injector body prior to injection where it is heated further due to heat from the combustion chamber. The temperature of the fuel at the tip of the injector can be as high as 250-350° C.

Thus the fuel is stressed at pressures from 1350 bar ($1.35\times10^8$ Pa) to over 2000 bar ($2\times10^8$ Pa) and temperatures from around 100° C. to 350° C. prior to injection, sometimes being recirculated back within the fuel system thus increasing the time for which the fuel experiences these conditions.

A common problem with diesel engines is fouling of the injector, particularly the injector body, and the injector nozzle. Fouling may also occur in the fuel filter. Injector nozzle fouling occurs when the nozzle becomes blocked with deposits from the diesel fuel. Fouling of fuel filters may be related to the recirculation of fuel back to the fuel tank. Deposits increase with degradation of the fuel. Deposits may take the form of carbonaceous coke-like residues, lacquers or sticky or gum-like residues. Diesel fuels become more and more unstable the more they are heated, particularly if heated under pressure. Thus diesel engines having high pressure fuel systems may cause increased fuel degradation. In recent years the need to reduce emissions has led to the continual redesign of injection systems to help meet lower targets. This has led to increasingly complex injectors and lower tolerance to deposits.

The problem of injector fouling may occur when using any type of diesel fuels. However, some fuels may be particularly prone to cause fouling or fouling may occur more quickly when these fuels are used. For example, fuels containing biodiesel and those containing metallic species may lead to increased deposits.

When injectors become blocked or partially blocked, the delivery of fuel is less efficient and there is poor mixing of the fuel with the air. Over time this leads to a loss in power of the engine and increased exhaust emissions and poor fuel economy.

Deposits are known to occur in the spray channels of the injector, leading to reduced flow and power loss. As the size of the injector nozzle hole is reduced, the relative impact of deposit build up becomes more significant. Deposits are also known to occur at the injector tip. Here they affect the fuel spray pattern and cause less effective combustion and associated higher emissions and increased fuel consumption.

In addition to these "external" injector deposits in the nozzle hole and at the injector tip which lead to reduced flow and power loss, deposits may occur within the injector body causing further problems. These deposits may be referred to as internal diesel injector deposits (or IDIDs). IDIDs occur form further up inside the injector on the critical moving parts. They can hinder the movement of these parts affecting the timing and quantity of fuel injection. Since modern diesel engines operate under very precise conditions these deposits can have a significant impact on performance.

IDIDs cause a number of problems, including power loss and reduced fuel economy due to less than optimal fuel metering and combustion. Initially the user may experience cold start problems and/or rough engine running. These deposits can lead to more serious injector sticking. This occurs when the deposits stop parts of the injector from moving and thus the injector stops working. When several or all of the injectors stick the engine may fail completely.

The present inventors have studied these internal diesel injector deposits and have found that they contain a number of components. However they believe that the presence of lacquers and/or carboxylate residues lead to injector sticking.

Lacquers are varnish-like deposits which are insoluble in fuel and common organic solvents. Some occurrences of lacquers have been found by analysis to contain amide functionality and it has been suggested that they form due to the presence of low molecular weight amide containing species in the fuel.

Carboxylate residues may be present from a number of sources. By carboxylate residues we mean to refer to salts of carboxylic acids. These may be short chain carboxylic acids but more commonly long chain fatty acid residues are present. The carboxylic residues may be present as ammonium and/or metal salts. Both carboxylic acids and metals may be present in diesel fuel from a number of sources. Carboxylic acids are commonly added into fuel as lubricity additives and/or corrosion inhibitors; they may occur due to oxidation of the fuel and may form during the combustion process; residual fatty acids may be present in the fatty acid methyl esters included as biodiesel; and they may also be present as byproducts in other additives. Derivatives of fatty acids may also be present and these may react or decompose to form carboxylic acids.

Various metals may be present in fuel compositions. This may be due to contamination of the fuel during manufacture, storage, transport or use or due to contamination of fuel additives.

Metal species may also be added to fuels deliberately. For example transition metals are sometimes added as fuel borne catalysts to improve the performance of diesel particulate filters.

The present inventors believe that one of the causes of injector sticking occurs when metal or ammonium species react with carboxylic acid species in the fuel. One example of injector sticking has arisen due to sodium contamination of the fuel. Sodium contamination may occur for a number of reasons. For example sodium hydroxide may be used in a washing step in the hydrodesulfurisation process and could lead to contamination. Sodium may also be present due to the use of sodium-containing corrosion inhibitors in pipelines. Another example can arise from the presence of calcium from for example interaction with or contamination with a lubricant or from calcium chloride used in salt drying processes in refineries. Other metal contamination may occur for example during transportation due to water bottoms.

Metal contamination of diesel fuel and the resultant formation of carboxylate salts is believed to be a major cause of injector sticking. The formation of lacquers is yet another major cause of injector sticking.

One approach to combatting IDIDs and injector sticking resulting from carboxylate salts is to try to eliminate the source of metal contamination and/or carboxylic acids or to try to ensure that particularly problematic carboxylic acids are eliminated. This has not been entirely successful, and there is a need for additives to provide control of IDIDs.

Deposit control additives are often included in fuel to combat deposits in the injector nozzle or at the injector tip. These may be referred to herein as "external injector deposits". Additives are also used to control deposits on vehicle fuel filters. However additives which have been found to be useful to control "external deposits" and fuel filter deposits have not been found to be effective at controlling IDIDs. A challenge for the additive formulator is to file provide more effective detergents.

It is an aim of the present invention to provide methods and uses which improve the performance of a diesel engine, especially a diesel engine having a high pressure fuel system by preventing or reducing the formation of IDIDs and/or by reducing or removing existing IDIDs. It is a further aim of the invention to provide methods and uses which also provide control of "external injector deposits" and/or fuel filter deposits.

Reducing or preventing the formation of deposits may be regarded as providing "keep clean" performance. Reducing or removing existing deposits may be regarded as providing "clean up" performance. It is an aim of the present invention to provide "keep clean" and/or "clean up" performance in relation to IDIDs. It is a further aim to also provide "keep clean" and/or "clean up" performance in relation to external injector deposits and/or fuel filter deposits.

According to a first aspect of the present invention there is provided a method of combating internal diesel injector deposits caused by carboxylate residues and/or lacquers in the injectors of a diesel engine, the method comprising combusting in the engine a diesel fuel composition comprising (a) the reaction product of a carboxylic acid-derived acylating agent and an amine and (b) a quaternary ammonium salt additive.

According to a second aspect of the present invention there is provided the use of a combination of (a) the reaction product of a carboxylic acid-derived acylating agent and an amine and (b) a quaternary ammonium salt additive to combat internal diesel injector deposits caused by carboxylate residues and/or lacquers in the injectors of a diesel engine.

Preferred features of the first and second aspects of the present invention will now be described.

The present invention relates to combating internal diesel injector deposits caused by carboxylate residues and/or lacquers. By combating internal diesel injector deposits we mean to include the prevention of deposit formation, the reduction of deposit formation and/or the removal of existing deposits. Thus combatting IDIDs may refer to providing "keep clean" and/or "clean up" performance.

The present invention relates to combatting internal diesel injector deposits or IDIDs in the injectors of a diesel engine. This problem typically occurs in modern diesel engines having a high pressure fuel system. Preferably the diesel engine has a fuel injection system which comprises a high pressure fuel injection (HPFI) system. The fuel pressure may be greater than 1350 bar, for example greater than 1500 bar or greater than 2000 bar. Preferably, the diesel engine has fuel injection system which comprises a common rail injection system or a unit injection system for example a piezoelectric injector. The skilled person will have a good knowledge of such engines. In the common rail injection system fuel is compressed utilizing a high-pressure pump that supplies it to the fuel injection valves through a common rail. In the unit injection system the high-pressure pump and fuel injection valve are integrated in one assembly. Preferably, the diesel engine has a fuel injection system which comprises a common rail injection system.

By carboxylate residues we mean to refer to salts of carboxylic acids. These may be salts of monocarboxylic acids, dicarboxylic acids or polycarboxylic acids. Mixtures of two or more different compounds may be present. The acids may be short-chain carboxylic acids, for example having less than 8 carbon atoms. Suitably the carboxylate residues are salts of mono and/or dicarboxylic acids having from 8 to 40 carbon atoms, preferably 12 to 40, and most preferably 16 to 36 carbon atoms. The acid residues may be saturated or unsaturated. The carboxylate residues are suitably the residues of fatty acids of the type typically found in diesel fuel, for example as lubricity additives, corrosion inhibitors or from fatty acid methyl-esters used as biodiesel.

The carboxylate residues are present as metal or ammonium salts. Suitably they are present as metal salts. They may be present as transition metal salts, for example copper or zinc salts. Most commonly they are present as alkali metal or alkaline earth metal salts, especially alkali metal salts. They are often present as sodium or calcium salts, and particularly as sodium salts.

By lacquers we mean to refer to fuel insoluble varnish-like deposits. The reasons for the presence of these deposits is not fully understood but low molecular weight amide-containing species present in fuel additives or reaction products of amines present in the fuel or fuel additives with carboxylic acids as described above have been suggested as a contributing factor.

The present invention may combat internal diesel injector deposits caused by lacquers and/or carboxylate residues.

The present invention may combat internal diesel injector deposits caused by amide lacquers and/or carboxylate residues.

The present invention may combat internal diesel injector deposits caused by lacquers.

The present invention may combat internal diesel injector deposits caused by amide lacquers.

Preferably the present invention combats internal diesel injector deposits caused by carboxylate residues.

The present invention involves the use of a combination of additives to combat IDIDs. One of the additives used is (a) the reaction product of a carboxylic acid-derived acylating agent and an amine. These may also be referred to herein in general as acylated nitrogen-containing compounds.

Suitable acylated nitrogen-containing compounds may be made by reacting a carboxylic acid acylating agent with an amine and are known to those skilled in the art. In such compounds the acylating agent is linked to the amino compound through an imido, amido, amidine or acyloxy ammonium linkage.

Preferred acylated nitrogen-containing compounds are hydrocarbyl substituted. The hydrocarbyl substituent may be in either the carboxylic acid acylating agent derived portion of the molecule or in the amine derived portion of the molecule, or both. Preferably, however, it is in the acylating agent portion. A preferred class of acylated nitrogen-containing compounds suitable for use in the present invention are those formed by the reaction of an acylating agent having a hydrocarbyl substituent of at least 8 carbon atoms and a compound comprising at least one primary or secondary amine group.

The acylating agent may be a mono- or polycarboxylic acid (or reactive equivalent thereof) for example a substituted succinic, phthalic or propionic acid or anhydride.

Suitable hydrocarbyl substituted acylating agents and means of preparing them are well known in the art. For example a common method of preparing a hydrocarblyl substituted succinic acylating agent is by the reaction of maleic anhydride with an olefin using a chlorination route or a thermal route (the so-called "ene" reaction).

Illustrative of hydrocarbyl substituent based groups containing at least eight carbon atoms are n-octyl, n-decyl, n-dodecyl, tetrapropenyl, n-octadecyl, oleyl, chloroctadecyl, triicontanyl, etc. The hydrocarbyl based substituents may be made from homo- or interpolymers (e.g. copolymers, terpolymers) of mono- and di-olefins having 2 to 10 carbon atoms, for example ethylene, propylene, butane-1, isobutene, butadiene, isoprene, 1-hexene, 1-octene, etc. Preferably these olefins are 1-monoolefins. Alternatively the substituent may be made from other sources, for example monomeric high molecular weight alkenes (e.g. 1-tetracontene), aliphatic petroleum fractions, for example paraffin waxes and cracked analogs thereof, white oils, synthetic alkenes for example produced by the Ziegler-Natta process (e.g. poly(ethylene) greases) and other sources known to those skilled in the art. Any unsaturation in the substituent may if desired be reduced or eliminated by hydrogenation according to procedures known in the art.

The term "hydrocarbyl" as used herein denotes a group having a carbon atom directly attached to the remainder of the molecule and having a predominantly aliphatic hydrocarbon character. Suitable hydrocarbyl based groups may contain non-hydrocarbon moieties. For example they may contain up to one non-hydrocarbyl group for every ten carbon atoms provided this non-hydrocarbyl group does not significantly alter the predominantly hydrocarbon character of the group. Preferred hydrocarbyl based substituents are purely aliphatic hydrocarbon in character and do not contain such groups.

The hydrocarbyl-based substituents are preferably predominantly saturated, that is, they contain no more than one carbon-to-carbon unsaturated bond for every ten carbon-to-carbon single bonds present. Most preferably they contain no more than one carbon-to-carbon non-aromatic unsaturated bond for every 50 carbon-to-carbon bonds present.

The hydrocarbyl substituent in such acylating agents preferably comprises at least 10, more preferably at least 12, for example at least 30 or at least 40 carbon atoms. It may comprise up to about 200 carbon atoms. Preferably the hydrocarbyl substituent of the acylating agent has a number average molecular weight (Mn) of between 170 to 2800, for example from 250 to 1500, preferably from 500 to 1500 and more preferably 500 to 1100. An Mn of 700 to 1300 is especially preferred. In a particularly preferred embodiment, the hydrocarbyl substituent has a number average molecular weight of 700-1000, preferably 700-850 for example 750.

The carboxylic acid-derived acylating agent may comprise a mixture of compounds. For example a mixture of compounds having different hydrocarbyl substituents may be used. In some embodiments the acylating agent may have more than one hydrocarbyl substituent. In such embodiments each hydrocarbyl substituent may be the same or different.

Preferred hydrocarbyl-based substituents are polyisobutenes. Such compounds are known to the person skilled in the art.

Preferred hydrocarbyl substituted acylating agents are polyisobutenyl succinic anhydrides. These compounds are commonly referred to as "PIBSAs" and are known to the person skilled in the art.

Conventional polyisobutenes and so-called "highly-reactive" polyisobutenes are suitable for use in the invention. Highly reactive polyisobutenes in this context are defined as polyisobutenes wherein at least 50%, preferably 70% or more, of the terminal olefinic double bonds are of the vinylidene type as described in EP0565285. Particularly preferred polyisobutenes are those having more than 80 mol % and up to 100 mol % of terminal vinylidene groups such as those described in U.S. Pat. No. 7,291,758. Preferred polyisobutenes have have preferred molecular weight ranges as described above for hydrocarbyl substituents generally.

Other preferred hydrocarbyl groups include those having an internal olefin for example as described in the applicant's published application WO2007/015080.

An internal olefin as used herein means any olefin containing predominantly a non-alpha double bond, that is a beta or higher olefin. Preferably such materials are substantially completely beta or higher olefins, for example containing less than 10% by weight alpha olefin, more preferably less than 5% by weight or less than 2% by weight. Typical internal olefins include Neodene 151810 available from Shell.

Internal olefins are sometimes known as isomerised olefins and can be prepared from alpha olefins by a process of isomerisation known in the art, or are available from other sources. The fact that they are also known as internal olefins reflects that they do not necessarily have to be prepared by isomerisation.

Preferred carboxylic acid-derived acylating agents for use in preparing additive (a) of the present invention are polyisobutenyl substituted succinic anhydrides or PIBSAs. Especially preferred PIBSAs are those having a PIB molecular weight (Mn) of from 300 to 2800, preferably from 450 to 2300, more preferably from 500 to 1300.

To prepare additive (a) the carboxylic acid-derived acylating agent is reacted with an amine. Suitably it is reacted with a primary or secondary amine. Examples of some suitable amines will now be described.

Amine compounds useful for reaction with the acylating agents include polyalkylene polyamines of the general formula:

$$(R^3)_2N[U—N(R^3)]_nR^3$$

wherein each $R^3$ is independently selected from a hydrogen atom, a hydrocarbyl group or a hydroxy-substituted hydrocarbyl group containing up to about 30 carbon atoms, with proviso that at least one $R^3$ is a hydrogen atom, n is a whole number from 1 to 10 and U is a 01-18 alkylene group. Preferably each $R^3$ is independently selected from hydrogen, methyl, ethyl, propyl, isopropyl, butyl and isomers thereof. Most preferably each $R^3$ is ethyl or hydrogen. U is preferably a 01-4 alkylene group, most preferably ethylene.

Other useful amines include heterocyclic-substituted polyamines including hydroxyalkyl-substituted polyamines wherein the polyamines are as described above and the heterocyclic substituent is selected from nitrogen-containing aliphatic and aromatic heterocycles, for example piperazines, imidazolines, pyrimidines, morpholines and derivatives thereof.

Other useful amines for reaction with acylating agents include aromatic polyamines of the general formula:

$$Ar(NR^3{}_2)_y$$

wherein Ar is an aromatic nucleus of 6 to 20 carbon atoms, each $R^3$ is as defined above and y is from 2 to 8.

Specific examples of polyalkylene polyamines include ethylenediamine, diethylenetriamine, triethylenetetramine, tetraethylenepentamine, tri(tri-methylene)tetramine, pentaethylenehexamine, hexaethylene-heptamine, 1,2-propylenediamine, and mixtures thereof. Other commercially available materials which comprise complex mixtures of polyamines may also be used. For example, higher ethylene polyamines optionally containing all or some of the above in addition to higher boiling fractions containing 8 or more nitrogen atoms etc. Specific examples of hydroxyalkyl-substituted polyamines include N-(2-hydroxyethyl) ethylene diamine, N,N'-bis(2-hydroxyethyl) ethylene diamine, N-(3-hydroxybutyl) tetramethylene diamine, etc. Specific examples of the heterocyclic-substituted polyamines (2) are N-2-aminoethyl piperazine, N-2 and N-3 amino propyl morpholine, N-3(dimethyl amino) propyl piperazine, 2-heptyl-3-(2-aminopropyl) imidazoline, 1,4-bis (2-aminoethyl) piperazine, 1-(2-hydroxy ethyl) piperazine, and 2-heptadecyl-1-(2-hydroxyethyl)-imidazoline, etc. Specific examples of the aromatic polyamines (3) are the various isomeric phenylene diamines, the various isomeric naphthalene diamines, etc.

Preferred amines are polyethylene polyamines including ethylenediamine, diethylenetriamine, triethylenetetramine, tetraethylenepentamine, pentaethylenehexamine, hexaethylene-heptamine, and mixtures and isomers thereof.

In preferred embodiments the reaction product of the carboxylic acid derived acylating agent and an amine includes at least one primary or secondary amine group.

A preferred acylated nitrogen-containing compound for use herein is prepared by reacting a poly(isobutene)-substituted succinic acid-derived acylating agent (e.g., anhydride, acid, ester, etc.) wherein the poly(isobutene) substituent has a number average molecular weight (Mn) of between 170 to 2800 with a mixture of ethylene polyamines having 2 to about 9 amino nitrogen atoms, preferably about 2 to about 8 nitrogen atoms, per ethylene polyamine and about 1 to about 8 ethylene groups. These acylated nitrogen compounds are suitably formed by the reaction of a molar ratio of acylating agent:amino compound of from 10:1 to 1:10, preferably from 5:1 to 1:5, more preferably from 2:1 to 1:2 and most preferably from 2:1 to 1:1. In especially preferred embodiments, the acylated nitrogen compounds are formed by the reaction of acylating agent to amino compound in a molar ratio of from 1.8:1 to 1:1.2, preferably from 1.6:1 to 1:1.2, more preferably from 1.4:1 to 1:1.1 and most preferably from 1.2:1 to 1:1. Acylated amino compounds of this type and their preparation are well known to those skilled in the art and are described in for example EP0565285 and U.S. Pat. No. 5,925,151.

In especially preferred embodiments the acylated nitrogen-containing additive (a) comprises the reaction product of a polyisobutene-substituted succinic acid or succinic anhydride and a polyethylene polyamine to form a succinimide detergent. Preferred polyethylene polyamines include ethylenediamine, diethylenetriamine, triethylenetetramine, tetraethylenepentamine, pentaethylenehexamine, hexaethylene-heptamine and mixtures and isomers thereof. Suitably the polyisobutene substituent of the polyisobutene-substituted succinic acid or succinic anhydride has a number average molecular weight of between 500 and 2000, preferably between 500 and 1500, more preferably between 500 and 1100, suitably between 600 and 1000, preferably between 700 and 800, for example about 750.

The acylated nitrogen-containing additive (a) may comprise a mixture of two or more compounds.

In the additive used in the present invention preferably at least 50 wt % of the additive has a number average molecular weight of more than 400, preferably at least 70% of the molecules, more preferably at least 90%, preferably at least 95%, suitably at least 97%.

A suitable method of measuring the molecular weight distribution of the additive is GPC using polystyrene standards.

The skilled person will appreciate that polyisobutene-substituted succinimide detergent additives typically contain a complex mixture of compounds. Such compounds are usually prepared by reacting polyisobutene (PIB) with maleic anhydride (MA) to form a polyisobutene-substituted succinic anhydride (PIBSA), which is then reacted with the polyamine (PAM) to form a polyisobutene-substituted succinimide (PIBSI). In the reaction of the PIB and MA more than one MA can react with each PIB and some unreacted PIB may remain. Each PIBSA molecule can react with one or more PAM molecule as described above. Varying the ratios of the different starting materials and including intermediate purification steps can affect the ratio of the various component of the final additive material.

The quaternary ammonium salt additive (b) for use herein is suitably the reaction product of a nitrogen-containing species having at least one tertiary amine group and a quaternising agent.

Preferably the nitrogen containing species is selected from:

(i) the reaction product of a hydrocarbyl-substituted acylating agent and a compound comprising at least one tertiary amine group and a primary amine, secondary amine or alcohol group;

(ii) a Mannich reaction product comprising a tertiary amine group; and (iii) a polyalkylene substituted amine having at least one tertiary amine group.

Examples of quaternary ammonium salt and methods for preparing the same are described in the following patents, which are hereby incorporated by reference, US2008/0307698, US2008/0052985, US2008/0113890 and US2013/031827.

Component (i) may be regarded as the reaction product of a hydrocarbyl-substituted acylating agent and a compound having an oxygen or nitrogen atom capable of condensing with said acylating agent and further having a tertiary amino group.

When the nitrogen containing species includes component (i), the hydrocarbyl substituted acylating agent is preferably a mono- or polycarboxylic acid (or reactive equivalent thereof) for example a substituted succinic, phthalic or propionic acid.

Preferably, when the nitrogen containing species includes component (i), component (i) is different to additive(a).

Preferred hydrocarbyl substituted acylating agents for use in the preparation of component (i) are as defined in relation to additive (a).

Examples of the nitrogen or oxygen containing compounds capable of condensing with the acylating agent and further having a tertiary amino group can include but are not limited to: N,N-dimethylaminopropylamine, N,N-diethylaminopropylamine, N,N-dimethylamino ethylamine. The nitrogen or oxygen containing compounds capable of condensing with the acylating agent and further having a tertiary amino group can further include amino alkyl substituted heterocyclic compounds such as 1-(3-aminopropyl)imidazole and 4-(3-aminopropyl)morpholine, 1-(2-aminoethyl) piperidine, 3,3-diamino-N-methyldipropylamine, and 3'3-aminobis(N,N-dimethylpropylamine). Other types of nitrogen or oxygen containing compounds capable of condensing with the acylating agent and having a tertiary amino group include alkanolamines including but not limited to triethanolamine, trimethanolamine, N,N-dimethylaminopropanol, N,N-dimethylaminoethanol, N,N-diethylaminopropanol, N,N-diethylaminoethanol, N,N-diethylaminobutanol, N,N,N-tris(hydroxyethyl)amine, N,N,N-tris(hydroxymethyl)amine, N,N,N-tris(aminoethyl)amine, N,N-dibutylaminopropylamine and N,N,N'-trimethyl-N'-hydroxyethylbisaminoethylether; N,N-bis(3-dimethylaminopropyl)-N-isopropanolamine; N-(3-dimethylaminopropyl)-N,N-diisopropanolamine; N'-(3-(dimethylamino)propyl)-N,N-dimethyl 1,3-propanediamine; 2-(2-dimethylaminoethoxy) ethanol, and N,N,N'-trimethylaminoethylethanolamine.

In some preferred embodiments component (i) comprises a compound formed by the reaction of a hydrocarbyl-substituted acylating agent and an amine of formula (I) or (II):

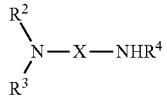

(I)

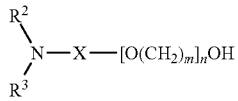

(II)

wherein $R^2$ and $R^3$ are the same or different alkyl, alkenyl or aryl groups having from 1 to 22 carbon atoms; X is a bond or is an alkylene group having from 1 to 20 carbon atoms; n is from 0 to 20; m is from 1 to 5; and $R^4$ is hydrogen or a $C_1$ to $C_{22}$ alkyl group.

When a compound of formula (I) is used, $R^4$ is preferably hydrogen or a $C_1$ to $C_{10}$ alkyl group, preferably a $C_1$ to $C_{10}$ alkyl group, more preferably a $C_1$ to $C_6$ alkyl group. When $R^4$ is alkyl it may be straight chained or branched. It may be substituted for example with a hydroxy or alkoxy substituent. Preferably $R^4$ is not a substituted alkyl group. More preferably $R^4$ is selected from hydrogen, methyl, ethyl, propyl, butyl and isomers thereof. Most preferably $R^4$ is hydrogen.

When a compound of formula (II) is used, m is preferably 2 or 3, most preferably 2; n is preferably from 0 to 15, preferably 0 to 10, more preferably from 0 to 5. Most preferably n is 0 and the compound of formula (II) is an alcohol.

Preferably the hydrocarbyl substituted acylating agent is reacted with a diamine compound of formula (I).

$R^2$ and $R^3$ are the same or different alkyl, alkenyl or aryl groups having from 1 to 22 carbon atoms. In some embodiments $R^2$ and $R^3$ may be joined together to form a ring structure, for example a piperidine, imidazole or morpholine moiety. Thus $R^2$ and $R^3$ may together form an aromatic and/or heterocyclic moiety. $R^2$ and $R^3$ may be branched alkyl or alkenyl groups. Each may be substituted, for example with a hydroxy or alkoxy substituent.

Preferably each of $R^2$ and $R^3$ is independently a $C_1$ to $C_{10}$ alkyl group, preferably a $C_1$ to $C_{10}$ alkyl group. $R^2$ and $R^3$ may independently be methyl, ethyl, propyl, butyl, pentyl, hexyl, heptyl, octyl, or an isomer of any of these. Preferably $R^2$ and $R^3$ is each independently $C_1$ to $C_4$ alkyl. Preferably $R^2$ is methyl. Preferably $R^3$ is methyl.

X is a bond or alkylene group having from 1 to 20 carbon atoms. In preferred embodiments when X is an alkylene group this group may be straight chained or branched. The alkylene group may include a cyclic structure therein. It may be optionally substituted, for example with a hydroxy or alkoxy substituent.

X is preferably an alkylene group having 1 to 16 carbon atoms, preferably 1 to 12 carbon atoms, more preferably 1 to 8 carbon atoms, for example 2 to 6 carbon atoms or 2 to 5 carbon atoms. Most preferably X is an ethylene, propylene or butylene group, especially a propylene group.

Examples of compounds of formula (I) suitable for use herein include 1-aminopiperidine, 1-(2-aminoethyl)piperidine, 1-(3-aminopropyl)-2-pipecoline, 1-methyl-(4-methylamino)piperidine, 4-(1-pyrrolidinyl)piperidine, 1-(2-aminoethyl)pyrrolidine, 2-(2-aminoethyl)-1-methylpyrrolidine, N,N-diethylethylenediamine, N,N-dimethylethylenediamine, N,N-dibutylethylenediamine, N,N-diethyl-1,3-diaminopropane, N,N-dimethyl-1,3-diaminopropane, N,N,N'-trimethylethylenediamine, N,N-dimethyl-N'-ethylethylenediamine, N,N-diethyl-N'-methylethylenediamine, N,N,N'-triethylethylenediamine, 3-dimethylaminopropylamine, 3-diethylaminopropylamine, 3-dibutylaminopropylamine, N,N,N'-trimethyl-1,3-propanediamine, N,N,2,2-tetramethyl-1,3-propanediamine, 2-amino-5-diethylaminopentane, N,N,N',N'-tetraethyldiethylenetriamine, 3,3'-diamino-N-methyldipropylamine, 3,3'-iminobis(N,N-dimethylpropylamine), 1-(3-aminopropyl) imidazole and 4-(3-aminopropyl)morpholine, 1-(2-aminoethyl)piperidine, 3,3-diamino-N-methyldipropylamine, 3,3-aminobis(N,N-dimethylpropylamine), or combinations thereof.

In some preferred embodiments the compound of formula (I) is selected from N,N-dimethyl-1,3-diaminopropane, N,N-diethyl-1,3-diaminopropane, N,N-dimethylethylenediamine, N,N-diethylethylenediamine, N,N-dibutylethylenediamine, or combinations thereof.

Examples of compounds of formula (II) suitable for use herein include alkanolamines including but not limited to triethanolamine, N,N-dimethylaminopropanol, N,N-diethylaminopropanol, N,N-diethylaminobutanol, triisopropanolamine, 1-[2-hydroxyethyl]piperidine, 2-[2-(dimethylamine)ethoxy]-ethanol, N-ethyldiethanolamine, N-methyldiethanolamine, N-butyldiethanolamine, N,N-diethylaminoethanol, N,N-dimethyl amino-ethanol, 2-dimethylamino-2-methyl-1-propanol, N,N,N'-trimethyl-N'-hydroxyethyl-bisaminoethylether; N,N-bis(3-dimethylaminopropyl)-N-isopropanolamine; N-(3-dimethylaminopropyl)-N,N-diisopropanolamine; N'-(3-(dimethylamino)propyl)-N,N-dimethyl 1,3-propanediamine; 2-(2-dimethylaminoethoxy)ethanol, and N,N,N'-trimethylaminoethylethanolamine.

In some preferred embodiments the compound of formula (B2) is selected from Triisopropanolamine, 1-[2-hydroxyethyl]piperidine, 2-[2-(dimethylamine)ethoxy]-ethanol, N-ethyldiethanolamine, N-methyldiethanolamine, N-butyldiethanolamine, N,N-diethylaminoethanol, N,N-dimethylaminoethanol, 2-dimethylamino-2-methyl-1-propanol, or combinations thereof.

An especially preferred compound of formula (I) is N,N-dimethyl-1,3-diaminopropane (dimethylaminopropylamine).

The preparation of some suitable quaternary ammonium salt additives in which the nitrogen-containing species includes component (i) is described in WO 2006/135881 and WO2011/095819.

Component (ii) is a Mannich reaction product having a tertiary amine. The preparation of quaternary ammonium salts formed from nitrogen-containing species including component (ii) is described in US 2008/0052985.

The Mannich reaction product having a tertiary amine group is prepared from the reaction of a hydrocarbyl-substituted phenol, an aldehyde and an amine.

The hydrocarbyl substituent of the hydrocarbyl substituted phenol can have 6 to 400 carbon atoms, suitably 30 to 180 carbon atoms, for example 10 or 40 to 110 carbon atoms. This hydrocarbyl substituent can be derived from an olefin or a polyolefin. Useful olefins include alpha-olefins, such as 1-decene, which are commercially available.

The polyolefins which can form the hydrocarbyl substituent can be prepared by polymerizing olefin monomers by well known polymerization methods and are also commercially available.

Some preferred polyolefins include polyisobutylenes having a number average molecular weight of 400 to 3000, in another instance of 400 to 2500, and in a further instance of 400 or 500 to 1500.

The hydrocarbyl-substituted phenol can be prepared by alkylating phenol with an olefin or polyolefin described above, such as, a polyisobutylene or polypropylene, using well-known alkylation methods.

In some embodiments the phenol may include a lower molecular weight alkyl substituent for example a phenol which carries one or more alkyl chains having a total of less 28 carbon atoms, preferably less than 24 carbon atoms, more preferably less than 20 carbon atoms, preferably less than 18 carbon atoms, preferably less than 16 carbon atoms and most preferably less than 14 carbon atoms.

A monoalkyl phenol may be preferred, suitably having from 4 to 20 carbons atoms, preferably 6 to 18, more preferably 8 to 16, especially 10 to 14 carbon atoms, for example a phenol having a C12 alkyl substituent.

The aldehyde used to form the Mannich detergent can have 1 to 10 carbon atoms, and is generally formaldehyde or a reactive equivalent thereof such as formalin or paraformaldehyde.

The amine used to form the Mannich detergent can be a monoamine or a polyamine.

Examples of monoamines include but are not limited to ethylamine, dimethylamine, diethylamine, n-butylamine, dibutylamine, allylamine, isobutylamine, cocoamine, stearylamine, laurylamine, methyllaurylamine, oleylamine, N-methyl-octylamine, dodecylamine, diethanolamine, morpholine, and octadecylamine.

Suitable polyamines may be selected from any compound including two or more amine groups. Suitable polyamines include polyalkylene polyamines, for example in which the alkylene component has 1 to 6, preferably 1 to 4, most preferably 2 to 3 carbon atoms. Preferred polyamines are polyethylene polyamines.

The polyamine has 2 to 15 nitrogen atoms, preferably 2 to 10 nitrogen atoms, more preferably 2 to 8 nitrogen atoms.

In especially preferred embodiments the amine used to form the Mannich detergent comprises a diamine. Suitably it includes a primary or secondary amine which takes part in the Mannich reaction and in addition a tertiary amine.

In preferred embodiments component (ii) comprises the product directly obtained from a Mannich reaction and comprising a tertiary amine. For example the amine may comprise a single primary or secondary amine which when reacted in the Mannich reaction forms a tertiary amine which is capable of being quaternised. Alternatively the amine may comprise a primary or secondary amine capable of taking part in the Mannich reaction and also a tertiary amine capable of being quaternised. However component (ii) may comprise a compound which has been obtained from a Mannich reaction and subsequently reacted to form a tertiary amine, for example a Mannich reaction may yield a secondary amine which is then alkylated to form a tertiary amine.

The preparation of quaternary ammonium salt additives in which the nitrogen-containing species includes component (iii) is described for example in US 2008/0113890.

The polyalkene-substituted amines having at least one tertiary amino group of the present invention may be derived from an olefin polymer and an amine, for example ammonia, momoamines, polyamines or mixtures thereof. They may be prepared by a variety of methods such as those described and referred to in US 2008/0113890.

Suitable preparation methods include, but are not limited to: reacting a halogenated olefin polymer with an amine; reacting a hydroformylated olefin with a polyamine and hydrogenating the reaction product; converting a polyalkene into the corresponding epoxide and converting the epoxide into the polyalkene substituted amine by reductive animation; hydrogenation of a β-aminonitrile; and hydroformylating an polybutene or polyisobutylene in the presence of a catalyst, CO and Hz at elevated pressure and temperatures.

The olefin monomers from which the olefin polymers are derived include polymerizable olefin monomers characterised by the presence of one or more ethylenically unsaturated groups for example ethylene, propylene, 1-butene, isobutene, 1-octene, 1,3-butadiene and isoprene.

The olefin monomers are usually polymerizable terminal olefins. However, polymerizable internal olefin monomers can also be used to form the polyalkenes.

Suitably the polyalkene substituent of the polyalkene-substituted amine is derived from a polyisobutylene.

The amines that can be used to make the polyalkene-substituted amine include ammonia, monoamines, polyamines, or mixtures thereof, including mixtures of different monoamines, mixtures of different polyamines, and mixtures of monoamines and polyamines (which include diamines). The amines include aliphatic, aromatic, heterocyclic and carbocylic amines. Preferred amines are generally substituted with at least one hydrocarbyl group having 1 to about 50 carbon atoms, preferably 1 to 30 carbon atoms. Saturated aliphatic hydrocarbon radicals are particularly preferred.

The monoamines and polyamines suitably include at least one primary or secondary amine group.

Examples of polyalkene-substituted amines can include: poly(propylene)amine, poly(butene)amine, N,N-dimethylpolyisobutyleneamine; N-polybutenemorpholine, N-poly(butene)ethylenediamine, N-poly(propylene) trimethylenediamine, N-poly(butene)diethylenetriamine, N',N'-poly(butene)tetraethylenepentamine, and N,N-dimethyl-N'poly(propylene)-1,3 propylenediamine.

The number average molecular weight of the polyalkene-substituted amines can range from 500 to 5000, or from 500 to 3000, for example from 1000 to 1500.

Any of the above polyalkene-substituted amines which are secondary or primary amines, may be alkylated to tertiary amines using alkylating agents. Suitable alkylating agents and method using these will be known to the person skilled in the art.

To form the quaternary ammonium salt additives useful in the present invention, the nitrogen containing species having a tertiary amine group is reacted with a quaternizing agent.

The quaternising agent may suitably be selected from esters and non-esters.

In some preferred embodiments, quaternising agents used to form the quaternary ammonium salt additives of the present invention are esters.

Preferred ester quaternising agents are compounds of formula (III):

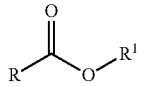

(III)

in which R is an optionally substituted alkyl, alkenyl, aryl or alkylaryl group and R1 is a C1 to C22 alkyl, aryl or alkylaryl group. The compound of formula (III) is suitably an ester of a carboxylic acid capable of reacting with a tertiary amine to form a quaternary ammonium salt.

Suitable quaternising agents include esters of carboxylic acids having a pKa of 3.5 or less.

The compound of formula (III) is preferably an ester of a carboxylic acid selected from a substituted aromatic carboxylic acid, an α-hydroxycarboxylic acid and a polycarboxylic acid.

In some preferred embodiments the compound of formula (III) is an ester of a substituted aromatic carboxylic acid and thus R is a substituted aryl group.

Preferably R is a substituted aryl group having 6 to 10 carbon atoms, preferably a phenyl or naphthyl group, most preferably a phenyl group. R is suitably substituted with one or more groups selected from carboalkoxy, nitro, cyano, hydroxy, SR5 or NR5R6. Each of R5 and R6 may be hydrogen or optionally substituted alkyl, alkenyl, aryl or carboalkoxy groups. Preferably each of R5 and R6 is hydrogen or an optionally substituted C1 to C22 alkyl group, preferably hydrogen or a C1 to C16 alkyl group, preferably hydrogen or a C1 to 010 alkyl group, more preferably hydrogen C1 to C4 alkyl group. Preferably R5 is hydrogen and R6 is hydrogen or a C1 to C4 alkyl group. Most preferably R5 and R6 are both hydrogen. Preferably R is an aryl group substituted with one or more groups selected from hydroxyl, carboalkoxy, nitro, cyano and NH2. R may be a poly-substituted aryl group, for example trihydroxyphenyl. Preferably R is a mono-substituted aryl group. Preferably R is an ortho substituted aryl group. Suitably R is substituted with a group selected from OH, NH2, NO2 or COOMe. Preferably R is substituted with an OH or NH2 group. Suitably R is a hydroxy substituted aryl group. Most preferably R is a 2-hydroxyphenyl group.

Preferably R1 is an alkyl or alkylaryl group. R1 may be a C1 to C16 alkyl group, preferably a C1 to 010 alkyl group, suitably a C1 to C8 alkyl group. R1 may be C1 to C16 alkylaryl group, preferably a C1 to C10 alkyl group, suitably a C1 to C8 alkylaryl group. R1 may be methyl, ethyl, propyl, butyl, pentyl, benzyl or an isomer thereof. Preferably R1 is benzyl or methyl. Most preferably R1 is methyl.

Especially preferred compounds of formula (III) are lower alkyl esters of salicylic acid such as methyl salicylate, ethyl salicylate, n and i propyl salicylate, and butyl salicylate, preferably methyl salicylate.

In some embodiments the compound of formula (III) is an ester of an α-hydroxycarboxylic acid. In such embodiments the compound has the structure:

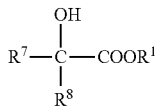

wherein R7 and R8 are the same or different and each is selected from hydrogen, alkyl, alkenyl, aralkyl or aryl. Compounds of this type suitable for use herein are described in EP 1254889.

Examples of compounds of formula (III) in which RCOO is the residue of an α-hydroxycarboxylic acid include methyl-, ethyl-, propyl-, butyl-, pentyl-, hexyl-, benzyl-, phenyl-, and allyl esters of 2-hydroxyisobutyric acid; methyl-, ethyl-, propyl-, butyl-, pentyl-, hexyl-, benzyl-, phenyl-, and allyl esters of 2-hydroxy-2-methylbutyric acid; methyl-, ethyl-, propyl-, butyl-, pentyl-, hexyl-, benzyl-, phenyl-, and allyl esters of 2-hydroxy-2-ethylbutyric acid; methyl-, ethyl-, propyl-, butyl-, pentyl-, hexyl-, benzyl-, phenyl-, and allyl esters of lactic acid; and methyl-, ethyl-, propyl-, butyl-, pentyl-, hexyl-, allyl-, benzyl-, and phenyl esters of glycolic acid. Of the above, a preferred compound is methyl 2-hydroxyisobutyrate.

In some embodiments the compound of formula (III) is an ester of a polycarboxylic acid. In this definition we mean to include dicarboxylic acids and carboxylic acids having more than 2 acidic moieties. In such embodiments RCOO is preferably present in the form of an ester, that is the one or more further acid groups present in the group R are in esterified form. Preferred esters are C1 to C4 alkyl esters.

The ester quaternising agent may be selected from the diester of oxalic acid, the diester of phthalic acid, the diester of maleic acid, the diester of malonic acid or the diester of citric acid. One especially preferred compound of formula (III) is dimethyl oxalate.

In preferred embodiments the compound of formula (III) is an ester of a carboxylic acid having a pKa of less than 3.5. In such embodiments in which the compound includes more than one acid group, we mean to refer to the first dissociation constant.

The ester quaternising agent may be selected from an ester of a carboxylic acid selected from one or more of oxalic acid, phthalic acid, salicylic acid, maleic acid, malonic acid, citric acid, nitrobenzoic acid, aminobenzoic acid and 2,4,6-trihydroxybenzoic acid.

Preferred ester quaternising agents include dimethyl oxalate, methyl 2-nitrobenzoate and methyl salicylate.

In some preferred embodiments, quaternising agents used to form the quaternary ammonium salt additives of the present invention are esters selected from dimethyl oxalate, methyl 2-nitrobenzoate and methyl salicylate, preferably dimethyl oxalate and methyl salicylate.

Suitable non-ester quaternising agents include dialkyl sulfates, benzyl halides, hydrocarbyl substituted carbonates, hydrocarbyl substituted epoxides in combination with an acid, alkyl halides, alkyl sulfonates, sultones, hydrocarbyl substituted phosphates, hydrocarbyl substituted borates, alkyl nitrites, alkyl nitrates, hydroxides, N-oxides or mixtures thereof.

In some embodiments the quaternary ammonium salt may be prepared from, for example, an alkyl or benzyl halide (especially a chloride) and then subjected to an ion exchange reaction to provide a different anion as part of the quaternary ammonium salt. Such a method may be suitable to prepare quaternary ammonium hydroxides, alkoxides, nitrites or nitrates.

Preferred non-ester quaternising agents include dialkyl sulfates, benzyl halides, hydrocarbyl substituted carbonates, hydrocarbyl susbsituted epoxides in combination with an acid, alkyl halides, alkyl sulfonates, sultones, hydrocarbyl substituted phosphates, hydrocarbyl substituted borates, N-oxides or mixtures thereof.

Suitable dialkyl sulfates for use herein as quaternising agents include those including alkyl groups having 1 to 10, preferably 1 to 4 carbons atoms in the alkyl chain. A preferred compound is dimethyl sulfate.

Suitable benzyl halides include chlorides, bromides and iodides. The phenyl group may be optionally substituted, for example with one or more alkyl or alkenyl groups, especially when the chlorides are used. A preferred compound is benzyl bromide.

Suitable hydrocarbyl substituted carbonates may include two hydrocarbyl groups, which may be the same or different. Each hydrocarbyl group may contain from 1 to 50 carbon atoms, preferably from 1 to 20 carbon atoms, more preferably from 1 to 10 carbon atoms, suitably from 1 to 5 carbon atoms. Preferably the or each hydrocarbyl group is an alkyl group. Preferred compounds of this type include diethyl carbonate and dimethyl carbonate.

Suitable hydrocarbyl susbsituted epoxides have the formula:

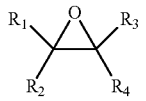

wherein each of R1, R2, R3 and R4 is independently hydrogen or a hydrocarbyl group having 1 to 50 carbon atoms. Examples of suitable epoxides include ethylene oxide, propylene oxide, butylene oxide, styrene oxide and stilbene oxide. The hydrocarbyl epoxides are used as quaternising agents in combination with an acid.

In embodiments in which the hydrocarbyl substituted acylating agent has more than one acyl group, and is reacted with the compound of formula (I) or formula (II) is a dicarboxylic acylating agent no separate acid needs to be added. However in other embodiments an acid such as acetic acid may be used.

Especially preferred epoxide quaternising agents are propylene oxide and styrene oxide.

Suitable alkyl halides for use herein include chlorides, bromides and iodides.

Suitable alkyl sulfonates include those having 1 to 20, preferably 1 to 10, more preferably 1 to 4 carbon atoms.

Suitable sultones include propane sultone and butane sultone.

Suitable hydrocarbyl substituted phosphates include dialkyl phosphates, trialkyl phosphates and O,O-dialkyl dithiophosphates. Preferred alkyl groups have 1 to 12 carbon atoms.

Suitable hydrocarbyl substituted borate groups include alkyl borates having 1 to 12 carbon atoms.

Preferred alkyl nitrites and alkyl nitrates have 1 to 12 carbon atoms.

Preferably the non-ester quaternising agent is selected from dialkyl sulfates, benzyl halides, hydrocarbyl substituted carbonates, hydrocarbyl susbsituted epoxides in combination with an acid, and mixtures thereof.

Especially preferred non-ester quaternising agents for use herein are hydrocarbyl substituted epoxides in combination with an acid. These may include embodiments in which a separate acid is provided or embodiments in which the acid is provided by the tertiary amine compound that is being quaternised. Preferably the acid is provided by the tertiary amine molecule that is being quaternised.

Preferred quaternising agents for use herein include dimethyl oxalate, methyl 2-nitrobenzoate, methyl salicylate and styrene oxide or propylene oxide optionally in combination with an additional acid.

To form some preferred ester derived quaternary ammonium salt additives of the present invention the compound of formula (III) is reacted with a compound formed by the reaction of a hydrocarbyl substituted acylating agent and an amine of formula (I) or (II).

The compounds of formula (I) or formula (II) are as described above.

The amine of formula (I) or (II) is reacted with a hydrocarbyl substituted acylating agent. The hydrocarbyl substituted acylating agent may be based on a hydrocarbyl substituted mono- di- or polycarboxylic acid or a reactive equivalent thereof. Preferably the hydrocarbyl substituted acylating agent is a hydrocarbyl substituted succinic acid compound such as a succinic acid or succinic anhydride.

The hydrocarbyl substituted acylating agent is suitably as defined above in relation to additive (a).

An especially preferred quaternary ammonium salt for use herein is formed by reacting methyl salicylate or dimethyl oxalate with the reaction product of a polyisobutylene-substituted succinic anhydride having a PIB molecular weight of 700 to 1300 and dimethylaminopropylamine.

The quaternary ammonium salt additives of the present invention may be prepared by any suitable method. Such methods will be known to the person skilled in the art and are exemplified herein. Typically the quaternary ammonium salt additives will be prepared by heating the quaternizing agent and the nitrogen-containing species having at least one tertiary amine group in an approximate 1:1 molar ratio, optionally in the presence of a solvent. The resulting crude reaction mixture may be added directly to a diesel fuel, optionally following removal of solvent.

Other suitable quaternary ammonium salts for use in the present invention include quaternised terpolymers, for example as described in US2011/0258917; quaternised copolymers, for example as described in US2011/0315107; and the acid-free quaternised nitrogen compounds disclosed in US2012/0010112.

US2011/0258917 describes a quaternized terpolymer formed from (A) ethylene, (B) a C2-C14-alkenyl ester of one or more aliphatic C1-C20-monocarboxylic acids or of one or more C1-C24-alkyl esters of acrylic acid or of methacrylic acid and (C) at least one ethylenically unsaturated monomer which comprises at least one tertiary nitrogen atom which is partly or fully in quaternized form.

US2011/0315107 describes quaternized copolymer obtainable by the reaction steps of (A) copolymerization of one or more straight-chain, branched or cyclic, ethylenically unsaturated C2 to C100 hydrocarbons (monomer M1), which may bear one or more oxygen- or nitrogen-functional substituents which cannot be reacted with amines to give amides or imides or with alcohols to give esters, with one or more ethylenically unsaturated C3- to C12-carboxylic acids or C3- to C12-carboxylic acid derivatives (monomer M2), which bear one or two carboxylic acid functions and can be reacted with amines to give amides or imides or with alcohols to give esters, to give a copolymer (CP) with a number-average molecular weight Mn of 500 to 20000; (B) partial or full amidation or imidation or esterification of the carboxylic acid functions of the (M2) units in the copolymer (CP) by reacting them with one or more oligoamines (OA) having 2 to 6 nitrogen atoms or alcoholamines (AA), each of which comprises at least one primary or secondary nitrogen atom or at least one hydroxyl group and at least one quaternizable tertiary nitrogen atom; (C) partial or full quaternization of the at least one tertiary nitrogen atom in the OA or AA units with at least one quaternizing agent (QM). The sequence of steps (B) and (C) may also be reversed, such that the partial or full amidation or imidation of esterification of the carboxylic acid functions of the (M2) units in the copolymer (CP) can be effected by reacting with the oligoamines (OA) or alcoholamines (AA) already quaternized in reaction step (C).

US2012/0010112 describes an acid-free process for preparing quaternized nitrogen compounds, wherein a) a compound comprising at least one oxygen- or nitrogen-containing group reactive with the anhydride and additionally comprising at least one quaternizable amino group is added onto a polycarboxylic anhydride compound, and b) the product from stage a) is quaternized using an epoxide quaternizing agent without an additional acid.

Further suitable quaternary ammonium compounds for use in the present invention include the quaternary ammonium compounds described in the applicants copending application WO2013/017889. These compounds are formed by the reaction of (1) a quaternising agent and (2) a compound formed by the reaction of a hydrocarbyl-substituted acylating agent and at least 1.4 molar equivalents of an amine of formula (I) or (II):

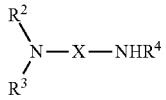

(I)

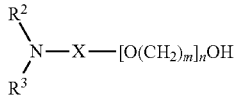

(II)

wherein R2 and R3 are the same or different alkyl, alkenyl or aryl groups having from 1 to 22 carbon atoms; X is a bond or alkylene group having from 1 to 20 carbon atoms; n is from 0 to 20; m is from 1 to 5; and R4 is hydrogen or a C1 to C22 alkyl group.

The hydrocarbyl substituted acylating agent and compounds (I) and (II) are preferably as defined above and ester and non-ester quaternizing agents of the types previously described herein are used.

Compound (2) is suitably prepared by reacting an amine of formula (I) or (II) and the hydrocarbyl substituted acylating agent in a molar ratio of at least 1.7:1 (amine:acylating agent), preferably at least 1.8:1, more preferably at least 1.9:1, for example at least 1.95:1.

In some embodiments the composition of the present invention may comprise a further additive, this further additive being the product of a Mannich reaction between:

(a) an aldehyde;

(b) a polyamine; and (c) an optionally substituted phenol.

Preferably the aldehyde component (a) is an aliphatic aldehyde. Preferably the aldehyde has 1 to 10 carbon atoms, preferably 1 to 6 carbon atoms, more preferably 1 to 3 carbon atoms. Most preferably the aldehyde is formaldehyde.

Polyamine component (b) of the Mannich additive may be selected from any compound including two or more amine groups. Preferably the polyamine is a polyalkylene polyamine. Most preferably the polyamine is a polyethylene polyamine. Preferably the polyamine has 2 to 15 nitrogen atoms, preferably 2 to 10 nitrogen atoms, more preferably 2 to 8 nitrogen atoms. The polyamine may, for example, be selected from ethylenediamine, diethylenetriamine, triethylenetetramine, tetraethylenepentamine, pentaethylenehexamine, hexaethyleneheptamine, heptaethyleneoctamine, propane-1,2-diamine, 2(2-amino-ethylamino)ethanol, and N',N'-bis (2-aminoethyl) ethylenediamine ($N(CH_2CH_2$ $NH_2)_3$). Most preferably the polyamine comprises tetraethylenepentamine or ethylenediamine.

Optionally substituted phenol component (c) may be substituted with 0 to 4 groups on the aromatic ring (in addition to the phenol OH). For example it may be a tri- or di-substituted phenol. Most preferably component (c) is a mono-substituted phenol. Preferably component (c) is a hydrocarbyl substituted phenol. Preferred hydrocarbyl substituents are alkyl substituents having 4 to 28 carbon atoms more preferably 8 to 16, especially 10 to 14 carbon atoms. Other preferred hydrocarbyl substituents are polyalkenyl substituents such polyisobutenyl substituents having an average molecular weight of from 400 to 2500, for example from 500 to 1500.

Suitable treat rates of the hydrocarbyl-substituted amine additive (a) and the quaternary ammonium salt additive (b) may depend on the type of fuel used and different levels of additive may be needed to achieve different levels of performance.

Suitably additive (a), the reaction product of a carboxylic acid-derived acylating agent and an amine is present in the diesel fuel composition in an amount of less than 10000 ppm, 1000 ppm preferably less than 500 ppm, preferably less than 250 ppm. In some embodiments additive (a) may be present in an amount of less than 200 ppm, for example less than 150 ppm or less than 100 ppm.

Suitably additive (a), the reaction product of a carboxylic acid-derived acylating agent and an amine is present in the diesel fuel composition in an amount of at least 1 ppm, preferably at least 5 ppm, preferably at least 10 ppm, for example at least 20 ppm or at least 25 ppm.

Suitably the quaternary ammonium salt additive (b) is present in the diesel fuel composition in an amount of less than 10000 ppm, preferably less than 1000 ppm, preferably less than 500 ppm, preferably less than 250 ppm. In some embodiments additive (b) may be present in an amount of less than 200 ppm, for example less than 150 ppm or less than 100 ppm.

Suitably the quaternary ammonium salt additive (b) is present in the diesel fuel composition in an amount of at least 1 ppm, preferably at least 5 ppm, preferably at least 10 ppm, for example at least 20 ppm or at least 25 ppm.

Each of additive (a) and additive (b) may be provided as a mixture of compounds. The above amounts refer to the total of all such compounds present in the composition.

For the avoidance of doubt the above amounts refer to the amount of active additive compound present in the composition and ignore any impurities, solvents or diluents which may be present.

The weight ratio of additive (a) to additive (b) is preferably from 1:10 to 10:1, preferably from 1:4 to 4:1, 1:2 to 2:1.

As stated previously, fuels containing biodiesel or metals are known to cause fouling. Severe fuels, for example those containing high levels of metals and/or high levels of biodiesel may require higher treat rates of the acylating nitrogen containing additive (a) and/or the quaternary ammonium salt additive (b) than fuels which are less severe.

The diesel fuel composition of the present invention may include one or more further additives such as those which are commonly found in diesel fuels. These include, for example, antioxidants, additional dispersants/detergents, metal deactivating compounds, wax anti-settling agents, cold flow improvers, cetane improvers, dehazers, stabilisers, demulsifiers, antifoams, corrosion inhibitors, lubricity improvers, dyes, markers, combustion improvers, metal deactivators, odour masks, drag reducers and conductivity improvers. Examples of suitable amounts of each of these types of additives will be known to the person skilled in the art.

By diesel fuel we include any fuel suitable for use in a diesel engine, either for road use or non-road use. This includes, but is not limited to, fuels described as diesel, marine diesel, heavy fuel oil, industrial fuel oil etc.

The diesel fuel composition of the present invention may comprise a petroleum-based fuel oil, especially a middle distillate fuel oil. Such distillate fuel oils generally boil within the range of from 110° C. to 500° C., e.g. 150° C. to 400° C. The diesel fuel may comprise atmospheric distillate or vacuum distillate, cracked gas oil, or a blend in any proportion of straight run and refinery streams such as thermally and/or catalytically cracked and hydro-cracked distillates.

The diesel fuel composition used in the present invention may comprise non-renewable Fischer-Tropsch fuels such as those described as GTL (gas-to-liquid) fuels, CTL (coal-to-liquid) fuels and OTL (oil sands-to-liquid).

The diesel fuel composition used in the present invention may comprise a renewable fuel such as a biofuel composition or biodiesel composition.

The diesel fuel composition may comprise 1st generation biodiesel. First generation biodiesel contains esters of, for example, vegetable oils, animal fats and used cooking fats. This form of biodiesel may be obtained by transesterification of oils, for example rapeseed oil, soybean oil, safflower oil, palm oil, corn oil, peanut oil, cotton seed oil, tallow, coconut oil, physic nut oil (Jatropha), sunflower seed oil, used cooking oils, hydrogenated vegetable oils or any mixture thereof, with an alcohol, usually a monoalcohol, in the presence of a catalyst.

The diesel fuel composition may comprise second generation biodiesel. Second generation biodiesel is derived from renewable resources such as vegetable oils and animal fats and processed, often in the refinery, often using hydroprocessing such as the H-Bio process developed by Petrobras. Second generation biodiesel may be similar in properties and quality to petroleum based fuel oil streams, for example renewable diesel produced from vegetable oils, animal fats etc. and marketed by ConocoPhillips as Renewable Diesel and by Neste as NExBTL.

The diesel fuel composition used in the present invention may comprise third generation biodiesel. Third generation biodiesel utilises gasification and Fischer-Tropsch technology including those described as BTL (biomass-to-liquid) fuels. Third generation biodiesel does not differ widely from some second generation biodiesel, but aims to exploit the whole plant (biomass) and thereby widens the feedstock base.

The diesel fuel composition may contain blends of any or all of the above diesel fuel compositions.

In some embodiments the diesel fuel composition used in the present invention may be a blended diesel fuel comprising bio-diesel. In such blends the bio-diesel may be present in an amount of, for example up to 0.5%, up to 1%, up to 2%, up to 3%, up to 4%, up to 5%, up to 10%, up to 20%, up to 30%, up to 40%, up to 50%, up to 60%, up to 70%, up to 80%, up to 90%, up to 95% or up to 99%.

In some embodiments the diesel fuel composition may comprise a secondary fuel, for example ethanol. Preferably however the diesel fuel composition does not contain ethanol.

The diesel fuel composition of the present invention may contain a relatively high sulphur content, for example greater than 0.05% by weight, such as 0.1% or 0.2%.

However in preferred embodiments the diesel fuel has a sulphur content of at most 0.05% by weight, more preferably of at most 0.035% by weight, especially of at most 0.015%. Fuels with even lower levels of sulphur are also suitable such as, fuels with less than 50 ppm sulphur by weight, preferably less than 20 ppm, for example 10 ppm or less.

As mentioned above, various metal species may be present in fuel compositions. This may be due to contamination of the fuel during manufacture, storage, transport or use or due to contamination of fuel additives. Metal species may also be added to fuels deliberately. For example transition metals are sometimes added as fuel borne catalysts, for example to improve the performance of diesel particulate filters.

The present inventors believe that problems of injector sticking occur when metal or ammonium species, particularly sodium species, react with carboxylic acid species in the fuel.

Sodium contamination of diesel fuel and the resultant formation of carboxylate salts is believed to be a major cause of injector sticking.

In preferred embodiments the diesel fuel compositions used in the present invention comprise sodium and/or calcium. Preferably they comprise sodium. The sodium and/or calcium is typically present in a total amount of from 0.01 to 50 ppm, preferably from 0.05 to 5 ppm preferably 0.1 to 2 ppm such as 0.1 to 1 ppm.

Other metal-containing species may also be present as a contaminant, for example through the corrosion of metal and metal oxide surfaces by acidic species present in the fuel or from lubricating oil. In use, fuels such as diesel fuels routinely come into contact with metal surfaces for example, in vehicle fuelling systems, fuel tanks, fuel transportation means etc. Typically, metal-containing contamination may comprise transition metals such as zinc, iron and copper; other group I or group II metals and other metals such as lead.

The presence of metal containing species may give rise to fuel filter deposits and/or external injector deposits including injector tip deposits and/or nozzle deposits.

In addition to metal-containing contamination which may be present in diesel fuels there are circumstances where metal-containing species may deliberately be added to the fuel. For example, as is known in the art, metal-containing fuel-borne catalyst species may be added to aid with the regeneration of particulate traps. The presence of such catalysts may also give rise to injector deposits when the fuels are used in diesel engines having high pressure fuel systems.

Metal-containing contamination, depending on its source, may be in the form of insoluble particulates or soluble compounds or complexes. Metal-containing fuel-borne catalysts are often soluble compounds or complexes or colloidal species.

In some embodiments, the diesel fuel may comprise metal-containing species comprising a fuel-borne catalyst. Preferably, the fuel borne catalyst comprises one or more metals selected from iron, cerium, platinum, manganese, Group I and Group II metals e.g., calcium and strontium. Most preferably the fuel borne catalyst comprises a metal selected from iron and cerium.

In some embodiments, the diesel fuel may comprise metal-containing species comprising zinc. Zinc may be present in an amount of from 0.01 to 50 ppm, preferably from 0.05 to 5 ppm, more preferably 0.1 to 1.5 ppm.

Typically, the total amount of all metal-containing species in the diesel fuel, expressed in terms of the total weight of metal in the species, is between 0.1 and 50 ppm by weight, for example between 0.1 and 20 ppm, preferably between 0.1 and 10 ppm by weight, based on the weight of the diesel fuel.

The present invention provides a method of combating internal diesel injector deposits caused by carboxylate residues and/or lacquers in the injectors of a diesel engine.

In some embodiments the method of the present invention may provide a reduction in or the prevention of the formation of IDIDs. This may be regarded as an improvement in "keep clean" performance. Thus the present invention may provide a method of reducing or preventing the formation of IDIDs caused by carboxylate residues and/or lacquers in the injectors of a diesel engine by combusting in said engine a diesel fuel composition comprising (a) the reaction product of a carboxylic acid-derived acylating agent and an amine and (b) a quaternary ammonium salt additive.

In some embodiments the method of the present invention may provide removal of existing IDIDs. This may be regarded as an improvement in "clean up" performance. Thus the present invention may provide a method of removing IDIDs caused by carboxylate residues and/or lacquers from the injectors of a diesel engine by combusting in said engine a diesel fuel composition comprising (a) the reaction product of a carboxylic acid-derived acylating agent and an amine and (b) a quaternary ammonium salt additive.

In especially preferred embodiments the first and second aspects of the present invention may be used to provide an improvement in "keep clean" and "clean up" performance.

As described above, the problem of internal diesel injector deposits (IDIDs) occurs in modern diesel engines having a high pressure fuel system.

Such diesel engines may be characterised in a number of ways.

Such engines are typically equipped with fuel injection equipment meeting or exceeding "Euro 5" emissions legislation or equivalent legislation in US or other countries.

Such engines are typically equipped with fuel injectors having a plurality of apertures, each aperture having an inlet and an outlet.

Such engines may be characterised by apertures which are tapered such that the inlet diameter of the spray-holes is greater than the outlet diameter.

Such modern engines may be characterised by apertures having an outlet diameter of less than 500 μm, preferably less than 200 μm, more preferably less than 150 μm, preferably less than 100 μm, most preferably less than 80 μm or less.

Such modern diesel engines may be characterised by apertures where an inner edge of the inlet is rounded.

Such modern diesel engines may be characterised by the injector having more than one aperture, suitably more than 2 apertures, preferably more than 4 apertures, for example 6 or more apertures.

Such modern diesel engines may be characterised by an operating tip temperature in excess of 250° C.

Such modern diesel engines may be characterised by a fuel injection system which provides a fuel pressure of more than 1350 bar, preferably more than 1500 bar, more preferably more than 2000 bar. Preferably, the diesel engine has fuel injection system which comprises a common rail injection system.

The method and use of the present invention preferably improves the performance of an engine having one or more of the above-described characteristics.

The present invention is particularly useful in the prevention or reduction or removal of internal deposits in injectors of engines operating at high pressures and temperatures in which fuel may be recirculated and which comprise a plurality of fine apertures through which the fuel is delivered to the engine. The present invention finds utility in engines for heavy duty vehicles and passenger vehicles. Passenger vehicles incorporating a high speed direct injection (or HSDI) engine may for example benefit from the present invention.

The present invention may also provide improved performance in modern diesel engines having a high pressure fuel system by controlling external injector deposits, for example those occurring in the injector nozzle and/or at the injector tip. The ability to provide control of internal injector deposits and external injector deposits is a useful advantage of the present invention.

Suitably the present invention may reduce or prevent the formation of external injector deposits. It may therefore provide "keep clean" performance in relation to external injector deposits.

Suitably the present invention may reduce or remove existing external injector deposits. It may therefore provide "clean up" performance in relation to external injector deposits.

The present invention may also combat deposits on vehicle fuel filters. This may include reducing or preventing the formation of deposits ("keep clean" performance) or the reduction or removal of existing deposits ("clean up" performance).

The diesel fuel compositions of the present invention may also provide improved performance when used with traditional diesel engines. Preferably the improved performance is achieved when using the diesel fuel compositions in modern diesel engines having high pressure fuel systems and when using the compositions in traditional diesel engines. This is important because it allows a single fuel to be provided that can be used in new engines and older vehicles.

The removal or reduction of IDIDs according to the present invention will lead to an improvement in performance of the engine.

The improvement in performance of the diesel engine system may be measured by a number of ways. Suitable methods will depend on the type of engine and whether "keep clean" and/or "clean up" performance is measured.

An improvement in "keep clean" performance may be measured by comparison with a base fuel. "Clean up" performance can be observed by an improvement in performance of an already fouled engine.

The effectiveness of fuel additives is often assessed using a controlled engine test.

In Europe the Co-ordinating European Council for the development of performance tests for transportation fuels, lubricants and other fluids (the industry body known as CEC), has developed a test for additives for modern diesel engines such as HSDI engines. The CEC F-98-08 test is used to assess whether diesel fuel is suitable for use in engines meeting new European Union emissions regulations known as the "Euro 5" regulations. The test is based on a Peugeot DW10 engine using Euro 5 injectors, and is commonly referred to as DW10 test. This test measures power loss in the engine due to deposits on the injectors, but is not specific to IDIDs.

The present inventors have modified the test to enable the effectiveness of an additive to prevent injector sticking due to the presence of carboxylate residues and/or lacquers to be assessed. In this modification, thermocouples are used to allow the exhaust temperature to be measured for each cylinder and thus the presence of injector sticking to be monitored. Also, sodium carboxylates and carboxylic acids are added to the fuel to increase the severity of the test with respect to injector sticking. The test is described in example 9.

The invention will now be further defined with reference to the following non-limiting examples.

EXAMPLE 1—ADDITIVE Q1

Additive Q1, a quaternary ammonium salt additive of the present invention was prepared as follows:

A mixture of succinic anhydride prepared from 1000 Mn polyisobutylene (21425 g) and diluent oil—pilot 900 (3781 g) were heated with stirring to 110° C. under a nitrogen atmosphere. Dimethylaminopropylamine (DMAPA, 2314 g) was added slowly over 45 minutes maintaining batch temperature below 115° C. The reaction temperature was increased to 150° C. and held for a further 3 hours. The resulting compound is a DMAPA succinimide.

This DMAPA succinimide was heated with styrene oxide (12.5 g), acetic acid (6.25 g) and methanol (43.4 g) under reflux (approx 80° C.) with stirring for 5 hours under a nitrogen atmosphere. The mixture was purified by distillation (30° C., −1 bar) to give the styrene oxide quaternary ammonium salt as a water white distillate.

EXAMPLE 2—ADDITIVE Q2

A reactor was charged with 33.2 kg (26.5 mol) PIBSA (made from 1000 MW PIB and maleic anhydride) and heated to 90° C. DMAPA (2.71 kg, 26.5 mol) was charged and the mixture stirred for 1 hour at 90-100° C. The temperature was increased to 140° C. for 3 hours and water removed. Methyl salicylate (4.04 kg, 26.5 mol) was charged and the mixture held at 140° C. for 8 hours. Caromax 20 (26.6 kg) was added.

EXAMPLE 3—ADDITIVE Q3

A reactor was charged with 8058 kg (6.69 kmol) PIBSA (made from 1000 MW PIB and maleic anhydride) and heated to 120° C. DMAPA (649 kg, 6.35 kmol) was added at 120-130° C. followed by 200 kg aromatic solvent. The mixture was held at 120-130° C. for one hour whilst removing water. The temperature was increased to 140° C. and the mixture held for a further three hours.

The reaction mixture was cooled to 110° C. and dimethyl oxalate (800 kg, 6.77 kmol) added, followed by 200 kg aromatic solvent. The batch was held at 110° C. for 2-3 hours. The batch was further diluted with 5742 kg of aromatic solvent before being cooled and discharged.

EXAMPLE 4—ADDITIVE A1

Additive A1 is a 60% active ingredient solution (in aromatic solvent) of a polyisobutenyl succinimide obtained from the condensation reaction of a polyisobutenyl succinic anhydride (PIBSA) derived from polyisobutene of Mn approximately 1000 with a polyethylene polyamine mixture of average composition approximating to triethylene tetramine. The product was obtained by mixing the PIBSA and polyethylene polyamine at 50° C. under nitrogen and heating at 160° C. for 5 hours with removal of water.

EXAMPLE 5—ADDITIVE A2

Additive A2 is a 60% active ingredient solution (in aromatic solvent) of a polyisobutenyl succinimide obtained from the condensation reaction of a polyisobutenyl succinic anhydride derived from polyisobutene of Mn approximately 750 with a polyethylene polyamine mixture of average composition approximating to tetraethylene pentamine. The product was obtained by mixing the PIBSA and polyethylene polyamine at 50° C. under nitrogen and heating at 160° C. for 5 hours with removal of water.

EXAMPLE 6

Fuel compositions were prepared by adding additives Q3 and A2 to diesel fuel.

The diesel fuel complied with the RF06 base fuel, the details of which are given in table 1 below.

TABLE 1

| | | Limits | | |
|---|---|---|---|---|
| | Units | Min | Max | Method |
| Property | | | | |
| Cetane Number | | 52.0 | 54.0 | EN ISO 5165 |
| Density at 15° C. | kg/m$^3$ | 833 | 837 | EN ISO 3675 |
| Distillation | | | | |
| 50% v/v Point | ° C. | 245 | — | |
| 95% v/v Point | ° C. | 345 | 350 | |
| FBP | ° C. | — | 370 | |
| Flash Point | ° C. | 55 | — | EN 22719 |
| Cold Filter Plugging Point | ° C. | — | −5 | EN 116 |
| Viscosity at 40° C. | mm$^2$/sec | 2.3 | 3.3 | EN ISO 3104 |
| Polycyclic Aromatic Hydrocarbons | % m/m | 3.0 | 6.0 | IP 391 |
| Sulphur Content | mg/kg | — | 10 | ASTM D 5453 |
| Copper Corrosion | | — | 1 | EN ISO 2160 |
| Conradson Carbon Residue on 10% Dist. Residue | % m/m | — | 0.2 | EN ISO 10370 |
| Ash Content | % m/m | — | 0.01 | EN ISO 6245 |
| Water Content | % m/m | — | 0.02 | EN ISO 12937 |
| Neutralisation (Strong Acid) Number | mg KOH/g | — | 0.02 | ASTM D 974 |
| Oxidation Stability | mg/mL | — | 0.025 | EN ISO 12205 |
| HFRR (WSD1,4) | µm | — | 400 | CEC F-06-A-96 |
| Fatty Acid Methyl Ester | | prohibited | | |

EXAMPLE 7

Fuel compositions were tested according to the CECF-98-08 DW 10B method, modified as appropriate.

The engine used in the test is the PSA DW10BTED4. In summary, the engine characteristics are:

Design: Four cylinders in line, overhead camshaft, turbocharged with EGR

Capacity: 1998 cm$^3$

Combustion chamber: Four valves, bowl in piston, wall guided direct injection

Power: 100 kW at 4000 rpm

Torque: 320 Nm at 2000 rpm

Injection system: Common rail with piezo electronically controlled 6-hole injectors.

Max. pressure: 1600 bar ($1.6\times10^8$ Pa). Proprietary design by SIEMENS VDO

Emissions control: Conforms with Euro 4 limit values when combined with exhaust gas post-treatment system (DPF)

This engine was chosen as a design representative of the modern European high-speed direct injection diesel engine capable of conforming to present and future European emissions requirements. The common rail injection system uses a highly efficient nozzle design with rounded inlet edges and conical spray holes for optimal hydraulic flow. This type of nozzle, when combined with high fuel pressure has allowed advances to be achieved in combustion efficiency, reduced noise and reduced fuel consumption, but are sensitive to influences that can disturb the fuel flow, such as deposit formation in the spray holes. The presence of these deposits causes a significant loss of engine power and increased raw emissions.

The test is run with a future injector design representative of anticipated Euro 5 injector technology.

It is considered necessary to establish a reliable baseline of injector condition before beginning fouling tests, so a sixteen hour running-in schedule for the test injectors is specified, using non-fouling reference fuel.

Full details of the CEC F-98-08 test method can be obtained from the CEC. The coking cycle is summarised below.

1. A warm up cycle (12 minutes) according to the following regime:

| Step | Duration (minutes) | Engine Speed (rpm) | Torque (Nm) |
|---|---|---|---|
| 1 | 2 | idle | <5 |
| 2 | 3 | 2000 | 50 |
| 3 | 4 | 3500 | 75 |
| 4 | 3 | 4000 | 100 |

2. 8 hrs of engine operation consisting of 8 repeats of the following cycle

| Step | Duration (minutes) | Engine Speed (rpm) | Load (%) | Torque (Nm) | Boost Air After IC (° C.) |
|---|---|---|---|---|---|
| 1 | 2 | 1750 | (20) | 62 | 45 |
| 2 | 7 | 3000 | (60) | 173 | 50 |
| 3 | 2 | 1750 | (20) | 62 | 45 |
| 4 | 7 | 3500 | (80) | 212 | 50 |
| 5 | 2 | 1750 | (20) | 62 | 45 |
| 6 | 10 | 4000 | 100 | * | 50 |
| 7 | 2 | 1250 | (10) | 20 | 43 |
| 8 | 7 | 3000 | 100 | * | 50 |
| 9 | 2 | 1250 | (10) | 20 | 43 |
| 10 | 10 | 2000 | 100 | * | 50 |
| 11 | 2 | 1250 | (10) | 20 | 43 |
| 12 | 7 | 4000 | 100 | * | 50 |

* for expected range see CEC method CEC-F-98-08

3. Cool down to idle in 60 seconds and idle for 10 seconds
4. 4 hrs soak period

The standard CEC F-98-08 test method consists of 32 hours engine operation corresponding to 4 repeats of steps 1-3 above, and 3 repeats of step 4. ie 44 hours total test time excluding warm ups and cool downs.

EXAMPLE 8

The diesel fuel compositions of table 2 below were prepared by adding additives Q3 and A2 to RF06 base fuel comprising 1 ppm zinc (as zinc neodecanoate).

The compositions were tested according to the CECF-98-08 DW10B test method described in example 7, modified as outlined below.

In the case of fuel compositions 1 and 2 listed in table 2, a first 32 hour cycle was run using new injectors and RF-06 base fuel having added thereto 1 ppm Zn (as neodecanoate). This resulted in a level of power loss due to fouling of the injectors.

A second 32 hour cycle was then run as a 'clean up' phase. The dirty injectors from the first phase were kept in the engine and the fuel changed to RF-06 base fuel having added thereto 1 ppm Zn (as neodecanoate) and the test additives specified.

FIG. 1 shows the power output of the engine when running the fuel compositions over the test period.

The results are also given in table 2.

TABLE 2

| | Treat Rate, ppm active | | Observed Power Loss, % | | |
|---|---|---|---|---|---|
| Composition | Additive Q3 | Additive A2 | Dirty Up Phase | Clean Up Phase after 10 hr | Clean Up Phase after 32 hr |
| 1 | | 240 | 4.7 | 1.6 | 1.4 |
| 2 | 120 | 120 | 5.4 | −0.3 | −0.7 |

EXAMPLE 9

The diesel fuel compositions of table 3 were prepared by dosing additives Q3 and A2 into a diesel fuel composition containing 1 ppm sodium as sodium 2-ethylhexanoate and 100 ppm of a mixture of carboxylic acids and organic solvents. The diesel fuel complied with the RF06 specification given above.

The compositions were tested according to the CECF-98-08 DW10B test method of example 7, modified by the addition of thermocouples to the engine. These were positioned to enable the exhaust temperature of each cylinder to be measured. This allows injector sticking to be tested.

The following results were obtained:

| Na Level, | Treat Rate, ppm active | | |
|---|---|---|---|
| ppm | Additive Q3 | Additive A2 | Result |
| 1 | — | — | 3 injectors stuck after 16 hours engine operation |
| 1 | 240 | — | 1 injector stuck after 32 hours operation |
| 1 | 120 | 120 | No injectors stuck after 32 hours engine operation |

The invention claimed is:

1. A method of combating internal diesel injector deposits caused by sodium carboxylate residues in the injectors of a diesel engine, the method comprising combusting in the engine a diesel fuel composition comprising (a) the reaction product of a carboxylic acid-derived acylating agent and an amine and (b) a quaternary ammonium salt additive; wherein the diesel engine has a fuel injection system which comprises a high pressure fuel injection (HPFI) system with fuel pressures greater than 1350 bar.

2. The method according to claim 1 wherein the acylated nitrogen-containing additive (a) comprises the reaction product of a polyisobutene-substituted succinic acid or succinic anhydride and a polyethylene polyamine.

3. The method according to claim 2 wherein the polyisobutene substituent of the polyisobutene-substituted succinic acid or succinic anhydride has a number average molecular weight of between 250 and 2300.

4. The method according to claim 2 wherein at least 90% of the succinimide molecules have a molecular weight of more than 400.

5. The method according to claim 3 wherein at least 90% of the succinimide molecules have a molecular weight of more than 400.

6. The method according to claim 1 wherein the quaternary ammonium salt additive (b) for use herein is the reaction product of a quaternising agent and a nitrogen-containing species having at least one tertiary amine group selected from:

(i) the reaction product of a hydrocarbyl-substituted acylating agent and a compound comprising at least one tertiary amine group and a primary amine, secondary amine or alcohol group;

(ii) a Mannich reaction product comprising a tertiary amine group; and (iii) a polyalkylene substituted amine having at least one tertiary amine group.

7. The method according to claim 6 wherein component (i) comprises one or more compounds formed by the reaction of a hydrocarbyl-substituted acylating agent and an amine of formula (I) or (II):

(I)

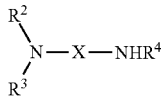

(II)

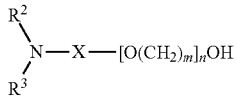

wherein $R^2$ and $R^3$ are the same or different alkyl groups having from 1 to 22 carbon atoms; X is an alkylene group having from 1 to 20 carbon atoms; n is from 0 to 20; m is from 1 to 5; and $R^4$ is hydrogen or a $C_1$ to $C_{22}$ alkyl group.

8. The method according to claim 7 wherein X is a propylene group.

9. The method according to claim 1 wherein the quaternising agent used to prepare the quaternary ammonium salt additive (b) is selected from the group consisting of dialkyl sulphates; an ester of a carboxylic acid; alkyl halides; benzyl halides; hydrocarbyl substituted carbonates; and hydrocarbyl epoxides in combination with an acid or mixtures thereof.

10. The method according to claim 1 wherein the quaternising agent used to prepare the quaternary ammonium salt additive (b) is a compound of formula (III):

(III)

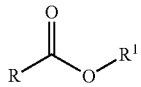

wherein R is an optionally substituted alkyl, alkenyl, aryl or alkylaryl group and $R^1$ is a $C_1$ to $C_{22}$ alkyl, aryl or alkylaryl group.

11. The method according to claim 10 wherein the quaternizing agent is selected from dimethyl oxalate, methyl 2-nitrobenzoate and methyl salicylate.

12. The method according to claim 1 which provides "keep clean" performance.

13. The method according to claim 1 which provides "clean up" performance.

14. The method according to claim 1 which further combats external injector deposits including those at the injector nozzle and at the injector tip and/or fuel filter deposits.

15. The method according to claim 14 which provides "keep clean" and/or "clean up" performance in relation to external injector deposits and/or fuel filter deposits.

16. The method according to claim 3 wherein the polyisobutene substituent of the polyisobutene-substituted succinic acid or succinic anhydride has a number average molecular weight of between 450 and 1500.

* * * * *